US005760745A

United States Patent [19]

Endo et al.

[11] Patent Number: 5,760,745

[45] Date of Patent: Jun. 2, 1998

[54] ELECTROSTATIC CAPACITIVELY COUPLED ANTENNA DEVICE

[75] Inventors: Tsutomu Endo; Toru Fukasawa, both of Kanagawa; Yonehiko Sunahara, Hyogo, all of Japan

[73] Assignee: Mitsubishi Denki Kabushiki Kaisha, Tokyo, Japan

[21] Appl. No.: 650,012

[22] Filed: May 17, 1996

[30] Foreign Application Priority Data

May 29, 1995 [JP] Japan ..... 7-130554

[51] Int. Cl.[6] ..... H01Q 1/24

[52] U.S. Cl. ..... 343/702; 343/725; 343/727; 343/729; 343/767

[58] Field of Search ..... 343/702, 750, 343/768, 725, 727, 729, 767, 895, 900, 901, 903, 703, 771; H01Q 1/24

[56] References Cited

U.S. PATENT DOCUMENTS

| | | | |
|---|---|---|---|
| 3,340,534 | 9/1967 | Fee | 343/768 |
| 3,474,453 | 10/1969 | Ireland | 343/750 |
| 3,631,500 | 12/1971 | Itoh | 343/725 |
| 4,381,566 | 4/1983 | Kane | 343/806 |
| 4,400,702 | 8/1983 | Tanaka | 343/806 |
| 5,298,907 | 3/1994 | Klein . | |

FOREIGN PATENT DOCUMENTS

| | | |
|---|---|---|
| 4-331501 | 11/1992 | Japan . |
| 2253949 | 9/1992 | United Kingdom . |

*Primary Examiner*—Hoanganh T. Le
*Assistant Examiner*—Tho Phan
*Attorney, Agent, or Firm*—Wolf, Greenfield & Sacks, P.C.

[57] ABSTRACT

A slot antenna includes a plate-like conductor provided vertically on the upper surface of the metallic cabinet and having a recess, whose length is equal to the half wavelength relative to a using frequency and whose depth is sufficiently smaller than the wavelength. Such a slot antenna is supplied with power to excite a half-wavelength conductor provided in the neighborhood thereof in a non-contact state through a electrostatic capacitive coupling.

35 Claims, 7 Drawing Sheets

ELECTROSTATIC CAPACITIVELY COUPLED ANTENNA DEVICE

BACKGROUND OF THE INVENTION

The present invention relates to an antenna device which can be suitably applied to a portable wireless device or the like.

A previously known portable wireless device has been disclosed in the Unexamined Japanese Patent Publication No. 4-331501. FIG. 13 is a sectional view of a wireless device body disclosed therein. FIG. 14 is a perspective view of an antenna mounted in the wireless device body. In these figures, reference numeral 25 denotes an antenna element; 26 a pipe-like portion; 27 a slit; and 28 a rod-like portion.

The antenna element 25 as shown in FIG. 14 is retractable. The rod-like portion 28 at the end of the antenna element has a larger diameter than that of the pipe-like portion 26. When the rod-like portion 28 is brought into contact with the inner wall of the pipe-like portion 26, the pipe-like portion 26 is resiliently deformed because of the slit 27 so as to support the rod-like portion 28. The pipe-like portion 26 is also used as a power supply contact.

The conventional antenna used in a portable wireless device has a defect that since the pipe-like portion 26 is made of metallic material, metal fatigue occurs in the slit 27 so that the pipe-like portion is not stably contact with the rod portion 28, thereby deteriorating the electric performance of the antenna. In order to realize stabilized contact of the rod-like potion 28 with the pipe-like portion 26, strict condition of precision in diameter size therebetween is required.

SUMMARY OF THE INVENTION

The present invention intends to improve the performance of an antenna device which can relax the size precision of the supporting structure of an antenna and is provided with an antenna in which a power supply portion itself can be operated as an built-in antenna and power is supplied by non-contact.

An antenna device defined in aspect 1 comprises a cabinet having a metallic surface serving as a grounding conductor on the outside; a square plate-like conductor provided vertically on the metallic surface and having a slot of a square recess formed on one side abutting on the metallic cabinet, whose length is equal to the half wavelength relative of a using frequency and whose depth is sufficiently smaller than the wavelength so as to constitute a slot antenna; a power supply line grounded to an area where the slot of the plate-like conductor is formed and operating to supply power to the slot antenna; and an antenna conductor which is perpendicular to the metallic surface and insulated from the slot antenna in the neighborhood of the slot antenna and supplied with power in non-contact coupling with the slot antenna.

An antenna device defined in aspect 2, in the antenna device according to aspect 1, is characterized in that the square shape plate-like conductor is bent in parallel to the metallic surface in its area where no slot is formed.

An antenna device defined in aspect 3, in the antenna device according to aspect 1, is characterized in that the square conductor is bent and snaked in a U-shape in a line perpendicular to the metallic surface.

An antenna device defined in aspect 4 comprises a cabinet having metallic surfaces serving as a grounding conductor on the outside extended over two surfaces of both sides of at least one side; a carpenter's square-shaped plate-like conductor provided substantially vertically on the metallic surface and having a slot of a square recess formed along the side abutting on the metallic surfaces, whose length is approximately equal to the half wavelength relative to a using frequency and whose depth is sufficiently smaller than the wavelength so as to constitute a slot antenna; a power supply line grounded to an area where the slot of the plate-like conductor is formed and operating to supply power to the slot antenna; and an antenna conductor which is substantially perpendicular to one of the metallic surfaces and insulated from the slot antenna and the metallic surfaces in the neighborhood of the slot antenna and supplied with power in non-contact coupling with the slot antenna.

An antenna device defined in aspect 5, in the antenna device according to aspect 1, is characterized in that the square plate-like conductor is bent in a V-shape in a line perpendicular to the metallic surface to displace the distance between grounding portions of the plate-like conductor from a half wavelength relative to a using frequency.

An antenna device defined in aspect 6, in the antenna device according to aspect 1, is characterized in that the square plate-like conductor is bent in a U-shape in a line perpendicular to the metallic surface to displace the distance between grounding portions of the plate-like conductor from a half wavelength relative to a using frequency.

An antenna device defined in aspect 7, in the antenna device according to aspect 6, is characterized in that a clip is attached to the bending portion of the U-shaped conductor, the clip being movable along a line perpendicular to the metallic surface at the bending portion.

An antenna device defined in aspect 8 is characterized in that the antenna conductor is a linear conductor having a length of approximately a half wavelength.

An antenna device defined in aspect 9 is characterized in that the antenna device is a linear conductor having a length of approximately a half wavelength and bent and snaked in a U-shape.

An antenna device defined in aspect 10 is characterized in that the antenna conductor is a spiral conductor having a length of approximately a half wavelength.

An antenna device defined in aspect 11 is characterized in that the antenna device is a linear conductor having a length of approximately a half wavelength and bent and snaked in a V-shape.

In an antenna device of the invention according to aspect 1 thus constructed, since the antenna conductor is provided in the neighborhood of the slot antenna provided perpendicularly to the upper surface of the metallic cabinet, the antenna conductor can be excited by electrostatic capacitive coupling with no contact for power supply.

In an antenna device of the invention according to aspects 2 to 4, the plate-like conductor on which the slot antenna is provided is miniaturized by e.g. bending so that the volume occupied when it is used as a built-in antenna can be reduced. Further, in an antenna device of the invention according to aspect 4, since the slot antenna includes a carpenter's square-shaped plate-like conductor, even when the cabinet is inclined during communication or the like, the radiating performance of the slot antenna can be maintained.

In an antenna device of the inventions according to aspects 5 and 6, the distance between the grounding portions can be displaced from the half wavelength relative to a using frequency so as to provide a radiating characteristic with no directivity. Further, in an antenna device defined in aspect 6, a slot is also provided in a different direction to provide an further improved radiating characteristic with no directivity.

In an antenna device of the invention according to aspect 7, the movable clip provided on the slot antenna is shifted to change the slot width of the slot antenna partially so that the impedance characteristic of the slot antenna is changed. Thus, the resonating frequency of the antenna device can be adjusted minutely.

The antenna device of the invention according to aspect 8, in which the antenna conductor has a simple shape, can be easily fabricated.

In an antenna device according to aspects 9 to 11, the longitudinal length of the antenna conductor can be made smaller than an actually used linear conductor so that the antenna device can be miniaturized.

DETAILED DESCRIPTION OF THE PREFERRED EMBODIMENTS (Embodiment 1)

Figure 1:
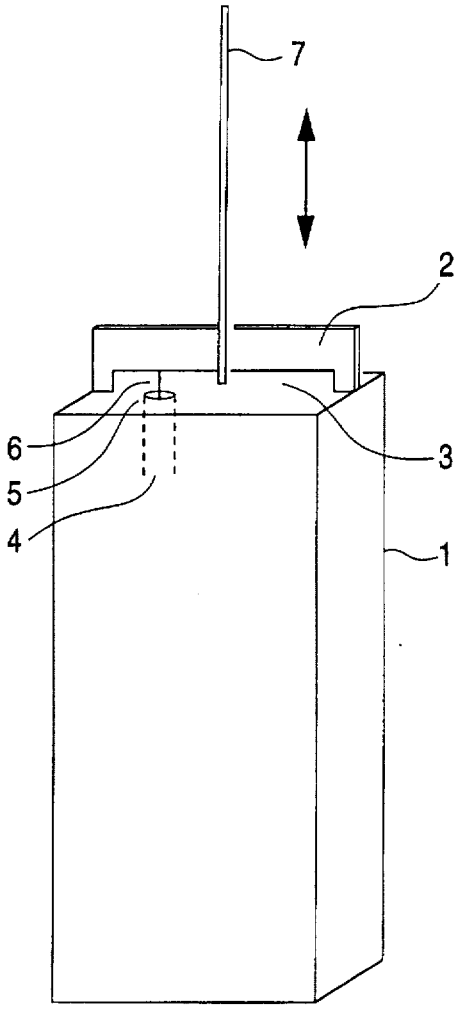
FIG. 1 is a schematic arrangement view of the first embodiment of the present invention.

FIG. 1 is a schematic arrangement view showing the first embodiment of the present invention. In FIG. 1, reference numeral 1 denotes a metallic cabinet or enclosure; 2 a plate-like conductor provided vertically on the upper surface of the metallic cabinet 1; 3 a square recess formed at an area of the plate-like conductor abutting on the metallic cabinet 1, whose length is equal to the half wavelength relative to a using frequency and whose depth is sufficiently smaller than the wavelength; 4 a coaxial passage for power whose outer conductor 5 is grounded to the upper surface of the metallic cabinet 1 and whose inner conductor 6 is connected to the plate-like conductor 2 so as to cross the recess 3; and 7 a movable half-wavelength linear conductor which is perpendicular to the upper surface of the metallic cabinet 1 and provided at a position in the neighborhood of the plate-like conductor 2 and not in contact with both metallic cabinet 1 and the plate-like conductor 2.

An explanation will be given of the operating theory of the antenna device according to this embodiment. Referring to FIG. 1, the metallic cabinet 1 and the plate-like conductor 2 with the recess 3 constitutes a half wavelength slot. The half wavelength slot, whose ends are apart by about the half wavelength from each other on upper surface of the metallic cabinet 1, excites a resonating mode whose electric field or voltage is maximum at the center and minimum at the both ends because of the electromagnetic wave which has propagated through the power supply coaxial passage 4. The center of the slot whose voltage is maximum and the end of the linear conductor 7 located in the neighborhood of the slot center and having an approximately half length of the resonating frequency are coupled with each other by an electrostatic capacitor, thereby exciting the linear conductor 7. The excited linear conductor serves as a half wavelength dipole. A band conductor having an approximately half wavelength can be substituted for the linear conductor.

(Embodiment 2)

Figure 2:
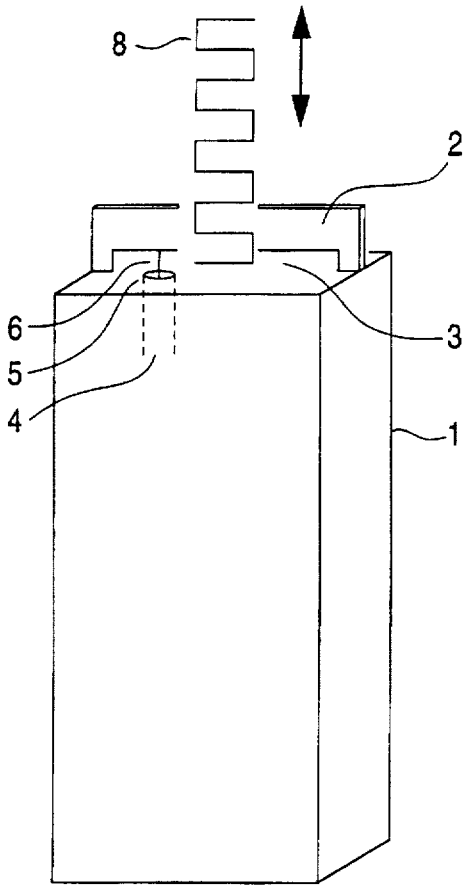
FIG. 2 is a schematic arrangement view of the second embodiment of the present invention.

FIG. 2 is a schematic arrangement view showing the second embodiment of the present invention. In FIG. 2, reference numeral 1 denotes a metallic cabinet or enclosure; 2 a plate-like conductor provided vertically on the upper surface of the metallic cabinet 1; 3 a square recess formed at an area of the plate-like conductor abutting on the metallic cabinet 1, whose length is approximately equal to the half wavelength relative to a using frequency and whose depth is sufficiently smaller than the wavelength; 4 a coaxial passage for power whose outer conductor 5 is grounded to the upper surface of the metallic cabinet 1 and whose inner conductor 6 is connected to the plate-like conductor 2 so as to cross the recess 3; and 8 a movable U-shaped snaking conductor which is a linear conductor perpendicular to the upper surface of the metallic cabinet 1, provided at a position in the neighborhood of the plate-like conductor 2 and not in contact with both metallic cabinet 1 and the plate-like conductor 2, having an approximately half wavelength in an electrical length and warping or snaking in a U-shape.

An explanation will be given of the operating theory of the antenna device according to this embodiment. On the basis of the same operating theory as in the first embodiment, the U-shaped snaking conductor 8 in a non-contact state is supplied with power. It should be noted that since the linear conductor is warped in a snake shape, the longitudinal length is shorter than the half wavelength, and hence the radiating portion is miniaturized.

(Embodiment 3)

Figure 3:
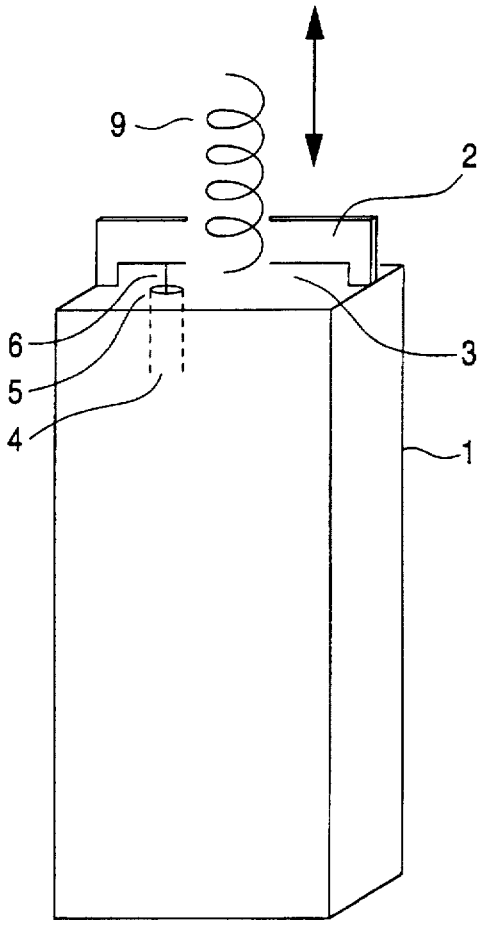
FIG. 3 is a schematic arrangement view of the third embodiment of the present invention.

FIG. 3 is a schematic arrangement view showing the third embodiment of the present invention. In FIG. 3, reference numeral 1 denotes a metallic cabinet or enclosure; 2 a plate-like conductor provided vertically on the upper surface of the metallic cabinet 1; 3 a square recess formed at an area of the plate-like conductor abutting on the metallic cabinet 1, whose length is equal to the half wavelength relative of a using frequency and whose depth is sufficiently smaller than the wavelength; 4 a coaxial passage for power whose outer conductor 5 is grounded to the upper surface of the metallic cabinet 1 and whose inner conductor 6 is connected to the plate-like conductor 2 so as to cross the recess 3; and 9 a movable spiral conductor which is a linear conductor perpendicular to the upper surface of the metallic cabinet 1, provided at a position in the neighborhood of the plate-like conductor 2 and not in contact with both metallic cabinet 1 and the plate-like conductor 2 and having an approximately half wavelength in an electrical length.

An explanation will be given of the operating theory of the antenna device according to this embodiment. On the basis of the same operating theory as in the first embodiment, the spiral conductor 9 in a non-contact state is supplied with power. It should be noted that since the linear conductor is warped spirally, the longitudinal length is shorter than the half wavelength, and hence the radiating portion is miniaturized.

(Embodiment 4)

Figure 4:
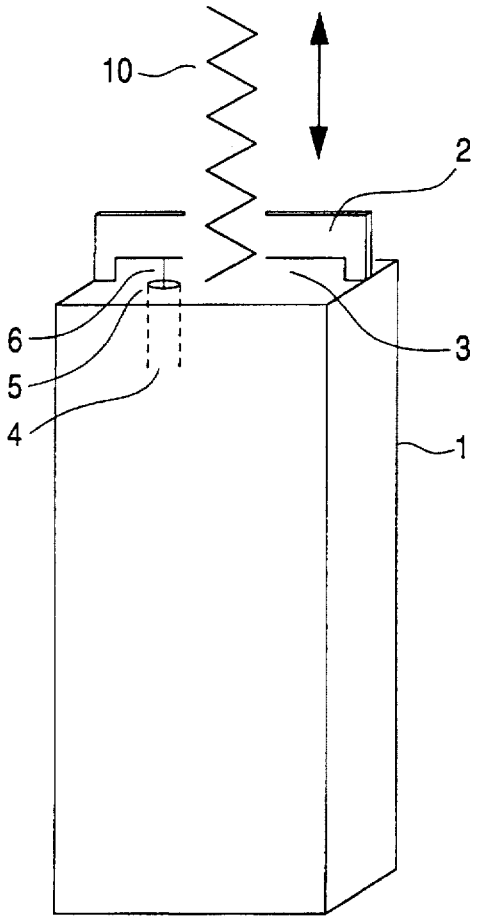
FIG. 4 is a schematic arrangement view of the fourth embodiment of the present invention.

FIG. 4 is a schematic arrangement view showing the fourth embodiment of the present invention. In FIG. 4, reference numeral 1 denotes a metallic cabinet or enclosure; 2 a plate-like conductor provided vertically on the upper surface of the metallic cabinet 1; 3 a square recess formed at an area of the plate-like conductor abutting on the metallic cabinet 1, whose length is equal to the half wavelength relative to a using frequency and whose depth is sufficiently smaller than the wavelength; 4 a coaxial passage for power whose outer conductor 5 is grounded to the upper surface of the metallic cabinet 1 and whose inner conductor 6 is connected to the plate-like conductor 2 so as to cross the recess 3; and 10 a movable spiral conductor which is a linear conductor perpendicular to the upper surface of the metallic cabinet 1, provided at a position in the neighborhood of the plate-like conductor 2 and not in contact with both metallic cabinet 1 and the plate-like conductor 2, having an approximately half wavelength in an electrical length and warping or snaking in a V-shape.

An explanation will be given of the operating theory of the antenna device according to this embodiment. On the basis of the same operating theory as in the first embodiment, the V-shaped conductor 10 in a non-contact state is supplied with power. It should be noted that since the linear conductor is warped in the V-shape, the longitudinal length is shorter than the half wavelength, and hence the radiating portion is miniaturized.

(Embodiment 5)

Figure 5:
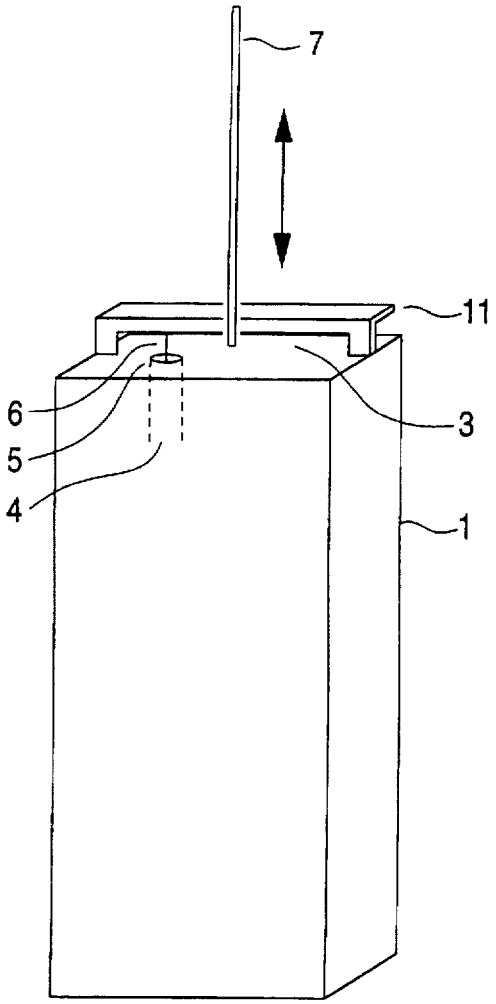
FIG. 5 is a schematic arrangement view of the fifth embodiment of the present invention.

FIG. 5 is a schematic arrangement view showing the first embodiment of the present invention. In FIG. 5, reference numeral 1 denotes a metallic cabinet or enclosure; 11 a plate-like conductor provided vertically on the upper surface of the metallic cabinet 1 and bent to so as to be in parallel thereto in a line in parallel thereto; 3 a square recess formed at an area of the plate-like conductor abutting on the metallic cabinet 1, whose length is equal to the half wavelength relative to a using frequency and whose depth is sufficiently smaller than the wavelength; 4 a coaxial passage for power whose outer conductor 5 is grounded to the upper surface of the metallic cabinet 1 and whose inner conductor 6 is connected to the plate-like conductor 11 so as to cross the recess 3; and 7 a movable half-wavelength linear conductor which is perpendicular to the upper surface of the metallic cabinet 1 and provided at a position in the neighborhood of the plate-like conductor 11 and not in contact with both metallic cabinet 1 and the plate-like conductor 11.

An explanation will be given of the operating theory of the antenna device according to this embodiment. On the basis of the same operating theory as in the first embodiment, the linear conductor in a non-contact state is supplied with power. It should be noted that since the linear conductor is bent to so as to be in parallel thereto in a line in parallel thereto, height of the plate-like conductor 11 can be reduced. Additionally, it should be noted that the linear conductor 7 may be a U-shaped snaking conductor, a spiral conductor or a V-shaped snaking conductor in the second, the third and the fourth conductor, respectively.

(Embodiment 6)

Figure 6:
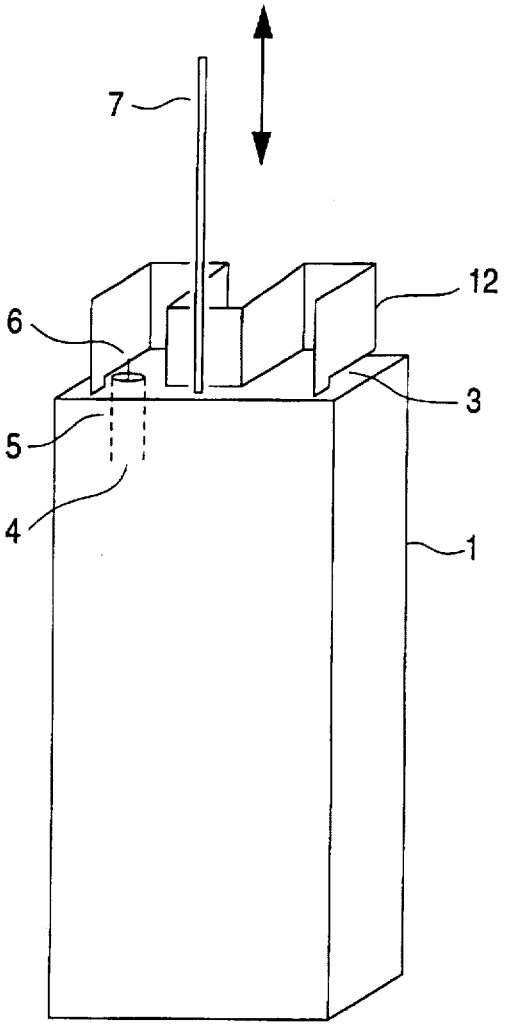
FIG. 6 is a schematic arrangement view of the sixth embodiment of the present invention.

FIG. 6 is a schematic arrangement view showing the sixth embodiment of the present invention. In FIG. 6, reference numeral 1 denotes a metallic cabinet or enclosure; 12 a plate-like conductor provided vertically on the upper surface of the metallic cabinet 1, having a square recess 3 formed along the side abutting on the upper surface of the metallic cabinet 1, whose length is approximately equal to the half wavelength relative to a using frequency and whose depth is sufficiently smaller than the wavelength and warping/snaking in a U-shape in a line perpendicular to the upper surface of the metallic cabinet 1; 4 a coaxial passage for power whose outer conductor 5 is grounded to the upper surface of the metallic cabinet 1 and whose inner conductor 6 is connected to the plate-like conductor 12 so as to cross the recess 3; and 7 a movable half-wavelength linear conductor which is perpendicular to the upper surface of the metallic cabinet 1 and provided at a position in the neighborhood of the plate-like conductor 12 and not in contact with both metallic cabinet 1 and the plate-like conductor 12.

An explanation will be given of the operating theory of the antenna device according to this embodiment. On the basis of the same operating theory as in the first embodiment, the linear conductor in a non-contact state is supplied with power. It should be noted that since the plate-like conductor 12 is bent in a snaking shape in a line perpendicular to the surface of the metallic cabinet 1, the longitudinal length of the snaking conductor 12 can be shortened. Additionally, it should be noted that the linear conductor 7 may be a U-shaped snaking conductor, a spiral conductor or a V-shaped snaking conductor in the second, the third and the fourth embodiment, respectively.

(Embodiment 7)

Figure 7:
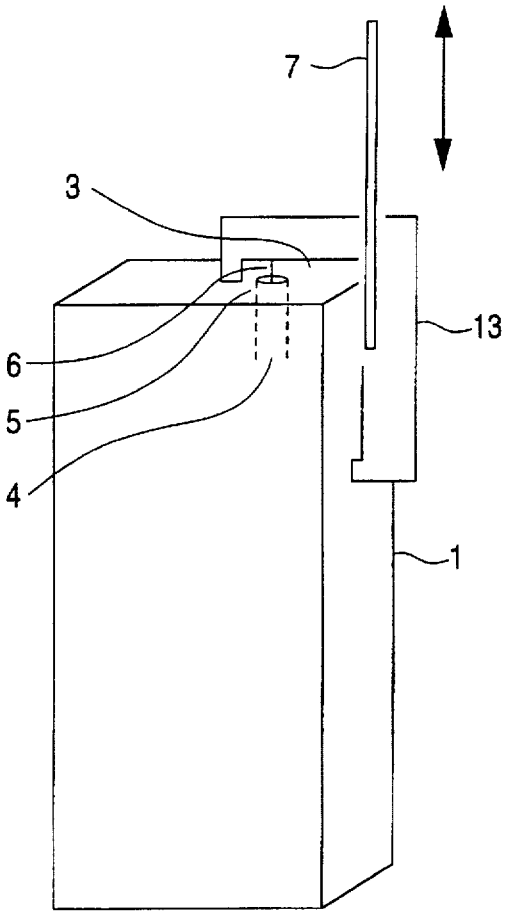
FIG. 7 is a schematic arrangement view of the seventh embodiment of the present invention.

FIG. 7 is a schematic arrangement view showing the seventh embodiment of the present invention. In FIG. 7, reference numeral 1 denotes a metallic cabinet or enclosure; 13 a carpenter's square-shaped plate-like conductor provided vertically on the upper surface and the one side of the metallic cabinet 1, and having a square recess 3 formed along the side abutting on the upper surface and the one side of the metallic cabinet 1, whose length is approximately equal to the half wavelength relative to a using frequency and whose depth is sufficiently smaller than the wavelength; 4 a coaxial passage for power whose outer conductor 5 is grounded to the upper surface of the metallic cabinet 1 and whose inner conductor 6 is connected to the carpenter's square-shaped conductor 13 so as to cross the recess 3; and 7 a movable half-wavelength linear conductor which is perpendicular to the upper surface of the metallic cabinet 1 and provided at a position in the neighborhood of the carpenter's square-shaped conductor 13 and not in contact with both metallic cabinet 1 and the carpenter's square-shaped conductor 13.

An explanation will be given of the operating theory of the antenna device according to this embodiment. On the basis of the same operating theory as in the first embodiment, the linear conductor in a non-contact state is supplied with power. It should be noted that since the carpenter's conductor 13 is provided in an area from the upper surface of the metallic cabinet 1 to the one side thereof, when the carpenter's conductor 13 is operated as a slot antenna, the polarized wave of the slot antenna is generated horizontally and vertically so that even when the cabinet is inclined, the performance of the antenna can be maintained. Additionally, it should be noted that the linear conductor 7 may be a U-shaped snaking conductor, a spiral conductor or a V-shaped snaking conductor in the second, the third and the fourth embodiment, respectively.

(Embodiment 8)

Figure 8:
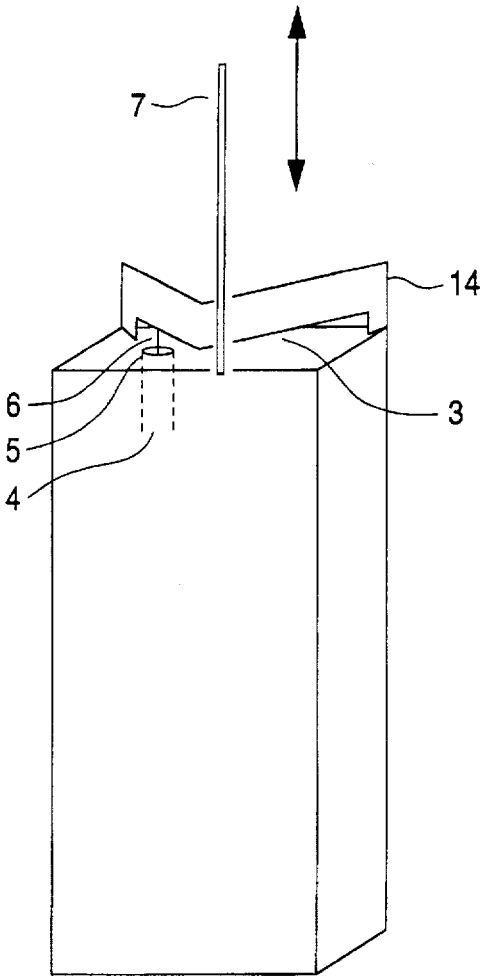
FIG. 8 is a schematic arrangement view of the eighth embodiment of the present invention.

FIG. 8 is a schematic arrangement view showing the fourth embodiment of the present invention. In FIG. 4, reference numeral 1 denotes a metallic cabinet or enclosure; 14 a V-shaped plate-like conductor provided vertically on the upper surface of the metallic cabinet 1, having a square recess 3 formed along the side abutting on the upper surface of the metallic cabinet 1, whose length is approximately equal to the half wavelength relative to a using frequency and whose depth is sufficiently smaller than the wavelength and bent in a V-shape in a line perpendicular to the upper surface of the metallic cabinet 1; 4 a coaxial passage for power whose outer conductor 5 is grounded to the upper surface of the metallic cabinet 1 and whose inner conductor 6 is connected to the V-shaped plate-like conductor 14 so as to cross the recess 3; and 10 a movable linear conductor which is perpendicular to the upper surface of the metallic cabinet 1, provided at a position in the neighborhood of the V-shaped conductor 14 and not in contact with both metallic cabinet 1 and the V-shaped conductor 2.

An explanation will be given of the operating theory of the antenna device according to this embodiment. On the basis of the same operating theory as in the first embodiment, the linear conductor 7 in a non-contact state is supplied with power. It should be noted to the following matter. Since the linear conductor is provided on the upper surface of the metallic cabinet 1, when the V-shaped conductor 14 is operated as a slot antenna, currents flow through the portion grounded to the upper surface of the metallic cabinet 1 in the same direction and spaced by an approximately half wavelength. In this case, if the conductor 14 is plate-like as shown in FIG. 1, the radiations in a longitudinal direction are canceled by each other and the radiation in a horizontal plane has directivity. In order to obviate such a disadvantage, the slot antenna is bent in a V-shape to displace the distance between the grounded portions from the half wavelength without increasing the linear occupying length in a longitudinal direction of the slot antenna, thus providing the radiating characteristic of substantially no directivity. Additionally, it should be also noted that the linear conductor 7 may be a U-shaped snaking conductor, a spiral conductor or a V-shaped snaking conductor in the second, the third and the fourth embodiment, respectively.

(Embodiment 9)

Figure 9:
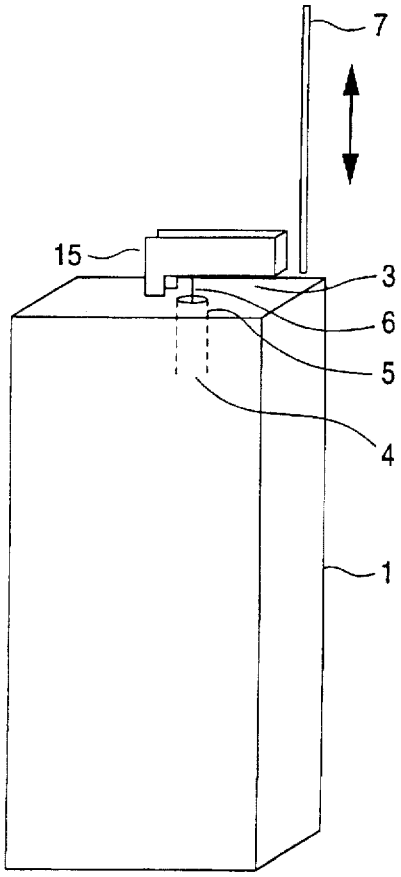
FIG. 9 is a schematic arrangement view of the ninth embodiment of the present invention.

FIG. 9 is a schematic arrangement view showing the sixth embodiment of the present invention. In FIG. 9, reference numeral 1 denotes a metallic cabinet or enclosure; 15 a U-shaped plate-like conductor provided vertically on the upper surface of the metallic cabinet 1, having a square recess 3 formed along the side abutting on the upper surface of the metallic cabinet 1, whose length is approximately equal to the half wavelength relative to a using frequency and whose depth is sufficiently smaller than the wavelength and bent in two pieces in a U-shape in a line perpendicular to the upper surface of the metallic cabinet 1; 4 a coaxial passage for power whose outer conductor 5 is grounded to the upper surface of the metallic cabinet 1 and whose inner conductor 6 is connected to the U-shaped conductor so as to cross the recess 3; and 7 a movable half-wavelength linear conductor which is perpendicular to the upper surface of the metallic cabinet 1 and provided at a position in the neighborhood of the plate-like conductor 2 and not in contact with both metallic cabinet 1 and the plate-like conductor 2.

An explanation will be given of the operating theory of the antenna device according to this embodiment. On the basis of the same operating theory as in the first embodiment, the linear conductor 7 in a non-contact state is supplied with power. The following matter should be noted. Since the U-shaped conductor 15 is provided on the upper surface of the metallic cabinet 1, when the U-shaped conductor 15 is operated as a slot antenna, currents flow through the portion grounded to the upper surface of the metallic cabinet in the same direction and spaced by an approximately half wavelength. In this case, if the conductor 15 is plate-like as shown in FIG. 1, the radiations in a longitudinal direction are canceled by each other and the radiation in a horizontal plane has directivity. In order to obviate such a disadvantage, the slot antenna is bent in a U-shape to displace the distance between the grounded portions from the half wavelength and to form a an opening of the slot antenna also in the previous longitudinal direction, thus providing the radiating characteristic of substantially no directivity. Additionally, it should be also noted that the linear conductor 7 may be a U-shaped snaking conductor, a spiral conductor or a V-shaped snaking conductor in the second, the third and the fourth embodiment, respectively.

(Embodiment 10)

Figure 10:
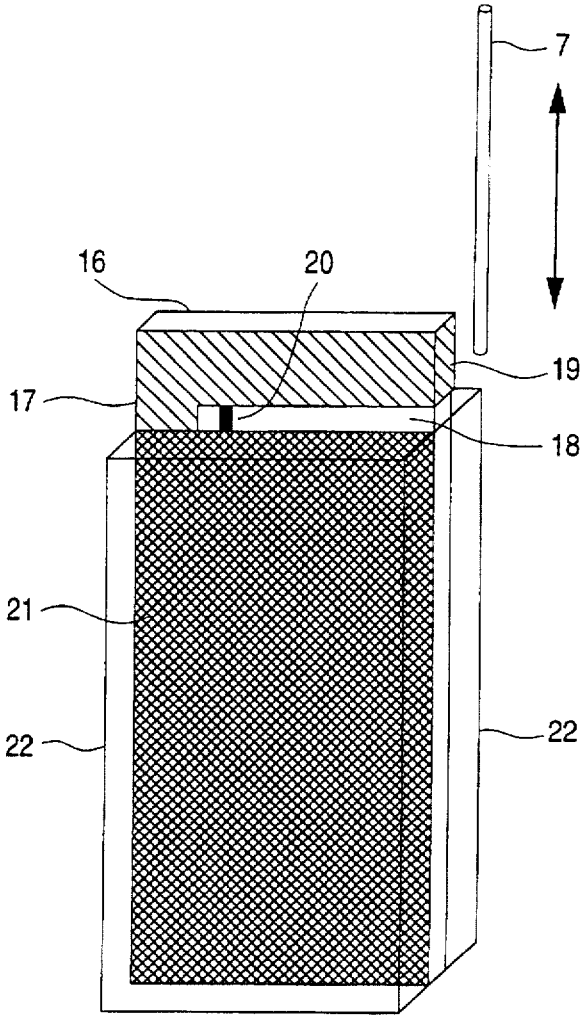
FIG. 10 is a schematic arrangement view of the tenth embodiment of the present invention.

FIG. 10 is a schematic diagram of the tenth embodiment of the present invention. In FIG. 10, reference numeral 16 denotes a circuit board; 17 key-shaped copper foil portions symmetrically left on the upper portions of both surfaces of the circuit board except a strip portion 18 where a copper foil is stripped so as to have an approximately ¼ wavelength in an electric length and a width much shorter than the wavelength at a resonating frequency. Reference numeral 19 denotes a conductor short-circuiting the key-shaped copper foil portions 17 provided on both surfaces of the circuit board; 20 a power supply line connecting a communication circuit portion 21 of the circuit board 16 to the key-shaped copper foil portions 17; 22 a shield case for covering the portions other than the key-shaped copper foil portions 17 of the circuit board 16 from both front and back sides of the circuit board; and 7 a linear conductor which is in parallel to the circuit board 16 and provided at a position in the neighborhood of the short-circuiting on the side of the circuit board 16 and not in contact with both circuit board 16 and shield case 22.

An explanation will be given of the operating theory of the antenna according to this embodiment. The construction of this embodiment is equivalent to that of FIG. 9 in the structure in which the portion other than the upper key-shaped copper foil portion 17 from both surfaces of the circuit board 16 is covered with the shield case 22. This embodiment is also equivalent to that of FIG. 9 in that power supplied from the communication circuit portion 21 on the circuit board 16 propagates through a micro-strip line or co-planar guide line and is supplied to the stripping portions 18 through the power supply line 20 so that the key-shaped copper foil portions serves as a slot resonator with the stripping portions 18 having a length of an approximately half wavelength in an electric length at a resonating frequency throughout both surfaces and short-circuited at their end. Accordingly, the linear conductor 7 is excited by the power supplied from the communication circuit portion 21. The characteristic when the key-shaped copper foil portions 17 operates as a slot antenna is also the same as in the embodiment of FIG. 9.

The antenna device according to this embodiment, in which the slot antenna portion and the communication portion can be formed on the same dielectric substrate by etching or the like, can be easily fabricated and hence is suited to mass production. The antenna device, in which these portions are formed on the dielectric substrate, has a wavelength shortening effect and so can be miniaturized. Additionally, it should be noted that the linear conductor 7 may be a U-shaped snaking conductor, a spiral conductor or a V-shaped snaking conductor in the second, the third and the fourth embodiment, respectively.

(Embodiment 11)

Figure 11:
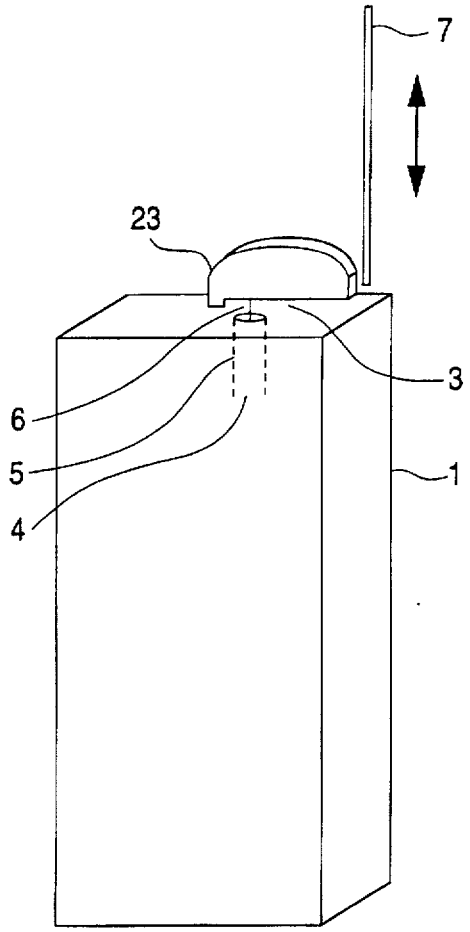
FIG. 11 is a schematic arrangement view of the eleventh embodiment of the present invention.

FIG. 11 is a schematic arrangement view showing the eleventh embodiment of the present invention. In FIG. 11, reference numeral 1 denotes a metallic cabinet or enclosure; 23 a U-shaped plate-like conductor provided vertically on the upper surface of the metallic cabinet 1, having a square recess 3 formed along the side abutting on the upper surface of the metallic cabinet 1, whose length is approximately equal to the half wavelength relative to a using frequency and whose depth is sufficiently smaller than the wavelength, bent in two pieces in a U-shape in a line perpendicular to the upper surface of the metallic cabinet 1 and cut in a semicircular shape in its upper portion; 4 a coaxial passage for power supply whose outer conductor 5 is grounded to the upper surface of the metallic cabinet 1 and whose inner conductor 6 is connected to the U-shaped conductor 23 so as to cross the recess 3; and 7 a movable half-wavelength linear conductor which is perpendicular to the upper surface of the metallic cabinet 1 and provided at a position in the neighborhood of the U-shaped conductor 23 and not in contact with both metallic cabinet 1 and the U-shaped conductor 23.

An explanation will be given of the operating theory of the antenna device according to this embodiment. On the basis of the same operating theory as in the ninth embodiment, the linear conductor 7 in a non-contact state is supplied with power. It should be noted that since the U-shaped conductor 15 is provided on the upper surface of the metallic cabinet 1, the U-shaped conductor 23 is cut in a semicircular shape in its upper portion, without deteriorating the performance of the antenna device, the volume of the antenna device when it is mounted in a cover, thereby miniaturizing the antenna device.

The upper portion of the U-shaped conductor 23 should not be limited to the semicircular shape, but may be any shape as long as the grounding portion and bending portion of the U-shaped conductor 23 which slightly influence the electromagnetic field of the slot antenna are cut in their upper part, thereby giving the same effects. Additionally, it should be noted that the linear conductor 7 may be a U-shaped snaking conductor, a spiral conductor or a V-shaped snaking conductor in the second, the third and the fourth embodiment, respectively.

(Embodiment 12)

Figure 12:
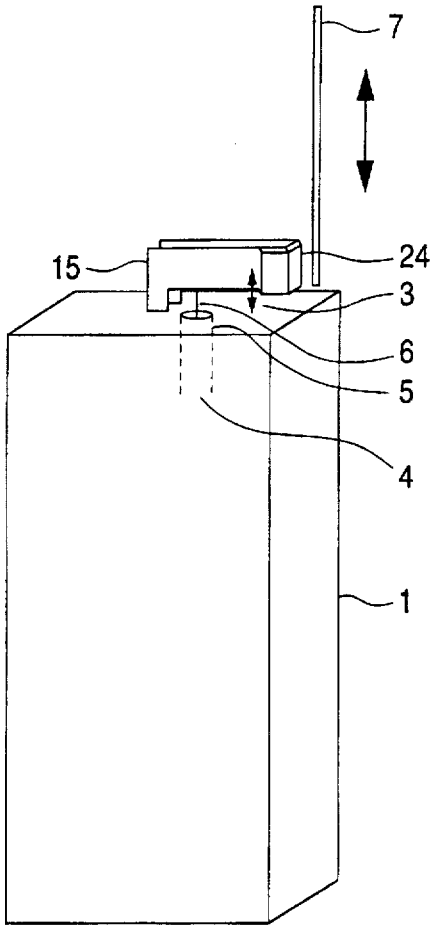
FIG. 12 is a schematic arrangement view of the twelfth embodiment of the present invention.
Figure 13:
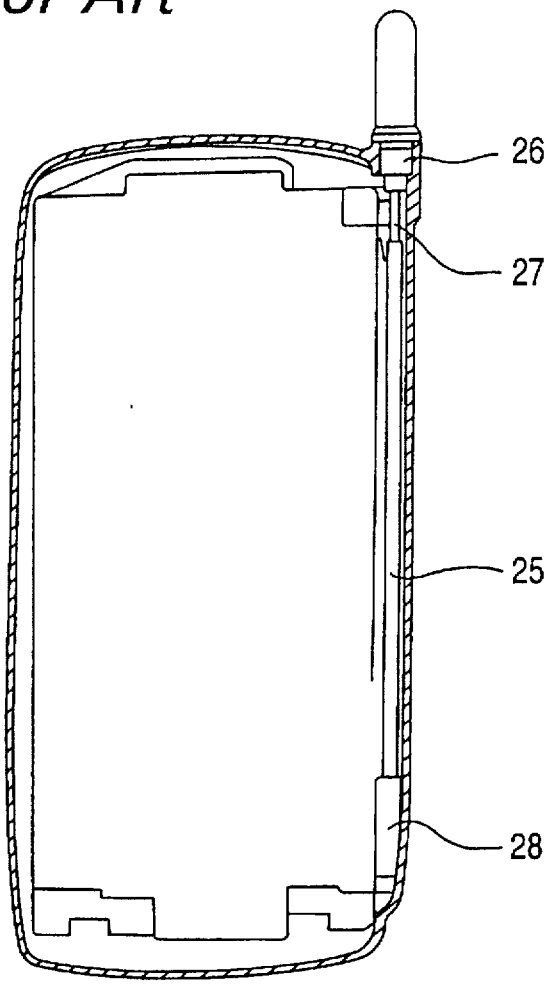
FIG. 13 Prior Art
FIG. 13 is a sectional view of the conventional wireless device.
Figure 14:
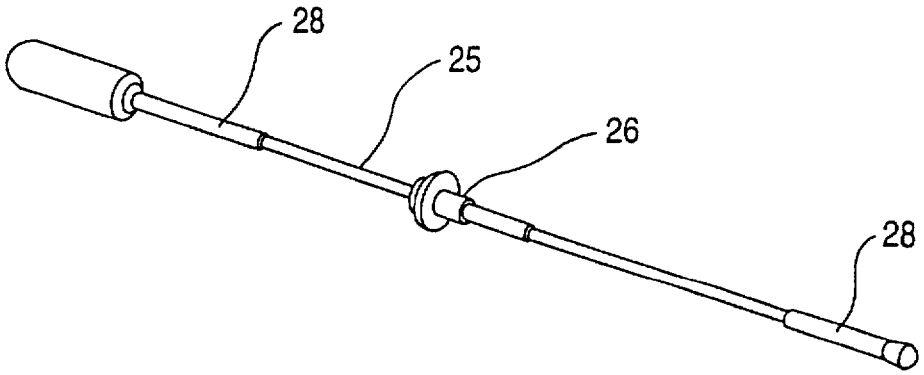
FIG. 14 Prior Art
FIG. 14 is a perspective view of the conventional antenna.

FIG. 12 is a schematic arrangement view showing the twelfth embodiment of the present invention. In FIG. 12, reference numeral 1 denotes a metallic cabinet or enclosure; 15 a U-shaped plate-like conductor provided vertically on the upper surface of the metallic cabinet 1, having a square recess 3 formed along the side abutting on the upper surface of the metallic cabinet 1, whose length is approximately equal to the half wavelength relative to a using frequency and whose depth is sufficiently smaller than the wavelength, bent in two pieces in a U-shape in a line perpendicular to the upper surface of the metallic cabinet 1 and cut in a semicircular shape in its upper portion; 4 a coaxial passage for power supply whose outer conductor 5 is grounded to the upper surface of the metallic cabinet 1 and whose inner conductor 6 is grounded to the U-shaped conductor 15 so as to cross the recess 3; 24 a movable clip slidably attached to the bending portion of the U-shaped conductor and having the same shape as it; and 7 a movable half-wavelength linear conductor which is perpendicular to the upper surface of the metallic cabinet 1 and provided at a position in the neighborhood of the U-shaped conductor 15 and not in contact with both metallic cabinet 1 and the U-shaped conductor 15.

An explanation will be given of the operating theory of the antenna device according to this embodiment. The U-shaped conductor is excited as a slot antenna as in the eighth embodiment and ninth embodiment. When the movable clip 24 is vertically slightly moved and adjusted to vary the width of the recess 3 which is a slot, the electrostatic capacitance between the portion of the slot grounded to the movable clip 24 and the metallic cabinet 1 so that the impedance frequency of the slot antenna can be changed to adjust the resonating frequency minutely.

According to the inventions defined in aspects 1 to 8, provision of the slot antenna supplied with power through a power supply line and the antenna conductor placed in the neighborhood thereof permits the slot antenna to operate as a built-in antenna, thus providing an antenna device with an antenna conductor which is supplied with power in a non-contact state.

According to the invention defined in aspect 2, the height of the slot antenna can be reduced, thus miniaturizing the antenna device.

According to the invention defined in aspect 4, since the slot antenna includes a carpenter's square-shaped plate-like conductor, even when the cabinet is inclined during communication or the like, the radiating performance of the slot antenna can be maintained.

According to the invention defined in aspect 5, the distance between the grounding portions can be displaced from the half wavelength relative to a using frequency, thus providing an antenna device having a radiating characteristic with no directivity.

According to the invention defined in aspect 6, the distance between the grounding portions can be displaced from the half wavelength relative to a using frequency and a slot is also provided in a different direction, thus providing an antenna device having an further improved radiating characteristic with no directivity.

According to the invention defined in aspect 7, since the impedance characteristic of the slot antenna is changed by a movable clip, the resonating frequency can be adjusted minutely.

According to the invention defined in aspect 8, the antenna conductor supplied with power in a non-contact state can be easily fabricated.

According to the inventions defined in aspects 9 to 11, the longitudinal length of the antenna conductor supplied with power in a non-contact state can be shortened, thus miniaturizing the antenna device.

What is claimed is:

1. An antenna device comprising:

a cabinet having a planar metallic surface serving as a grounding conductor on the outside thereof;

a substantially rectangular conductor provided transverse to the plane of the metallic surface and forming a slot of a rectangular recess with one side of the metallic surface, the slot having a length that is equal to a half wavelength relative to a frequency of use and having a depth that is sufficiently smaller than the wavelength so as to constitute a slot antenna;

a power supply line grounded to an area of the metallic surface where the slot is formed, and operating to supply power to said slot antenna; and an antenna conductor which is perpendicular to the plane of the metallic surface, insulated from said slot antenna and the metallic surface in a neighborhood of said slot antenna, and receiving power in non-contact coupling from said slot antenna.

2. The antenna device of claim 1, wherein said antenna conductor is a linear conductor having a length of approximately the half wavelength.

3. The antenna device of claim 1, wherein said antenna conductor is a linear conductor bent and snaked in a U-shape having a length of approximately the half wavelength.

4. The antenna device of claim 1, wherein said antenna conductor is a spiral conductor having a length of approximately the half wavelength.

5. The antenna device of claim 1, wherein said antenna conductor is a linear conductor bent and snaked in a V-shape having a length of approximately the half wavelength.

6. An antenna device comprising:

a cabinet having a planar metallic surface serving as a grounding conductor on the outside thereof;

a substantially rectangular conductor that is bent to form two portions including a first portion and a second portion, the first portion being oriented transverse to the plane of the metallic surface and contacting the metallic surface to form a slot of a rectangular recess with one side of the metallic surface, the slot having a length that is equal to a half wavelength relative to a frequency of use and having a depth that is sufficiently smaller than the wavelength so as to constitute a slot antenna, and the second portion being oriented parallel to the plane of the metallic surface;

a power supply line grounded to an area of the metallic surface where the slot is formed, and operating to supply power to said slot antenna; and an antenna conductor which is perpendicular to the plane of the metallic surface, insulated from said slot antenna and the metallic surface in a neighborhood of said slot antenna, and receiving power in non-contact coupling from said slot antenna.

7. The antenna device of claim 6, wherein said antenna conductor is a linear conductor having a length of approximately the half wavelength.

8. The antenna device of claim 6, wherein said antenna conductor is a linear conductor bent and snaked in a U-shape having a length of approximately the half wavelength.

9. The antenna device of claim 6, wherein said antenna conductor is a spiral conductor having a length of approximately the half wavelength.

10. The antenna device of claim 6, wherein said antenna conductor is a linear conductor bent and snaked in a V-shape having a length of approximately the half wavelength.

11. An antenna device comprising:

a cabinet having a planar metallic surface serving as a grounding conductor on the outside thereof;

a substantially rectangular conductor bent and snaked in a U-shape and provided transverse to the plane of the metallic surface and forming a U-shaped slot with one side of the metallic surface, the U-shaped slot having a length that is equal to a half wavelength relative to a frequency of use and having a depth that is sufficiently smaller than the wavelength so as to constitute a slot antenna;

a power supply line grounded to an area of the metallic surface where the U-shaped slot is formed, and operating to supply power to said slot antenna; and an antenna conductor which is perpendicular to the plane of the metallic surface, insulated from said slot antenna and the metallic surface in a neighborhood of said slot antenna, and receiving power in non-contact coupling from said slot antenna.

12. The antenna device of claim 11, wherein said antenna conductor is a linear conductor having a length of approximately the half wavelength.

13. The antenna device of claim 11, wherein said antenna conductor is a linear conductor bent and snaked in a U-shape having a length of approximately the half wavelength.

14. The antenna device of claim 11, wherein said antenna conductor is a spiral conductor having a length of approximately the half wavelength.

15. The antenna device of claim 11, wherein said antenna conductor is a linear conductor bent and snaked in a V-shape having a length of approximately the half wavelength.

16. An antenna device comprising:

a cabinet having planar metallic surfaces serving as a grounding conductor on the outside thereof, the metallic surfaces including a first metallic surface and a second metallic surface that is perpendicular to the first metallic surface;

an L-shaped conductor provided transverse to the planes of the first and second metallic surfaces and forming an L-shaped slot with a first side of the first and second metallic surfaces, the L-shaped slot having an L-shaped length that is approximately equal to a half wavelength relative to a frequency of use and having a depth that is sufficiently smaller than the wavelength so as to constitute a slot antenna;

a power supply line grounded to an area of one of the first and second metallic surfaces where the L-shaped slot is formed, and operating to supply power to said slot antenna; and an antenna conductor which is substantially perpendicular to the plane of the one of the first and second metallic surfaces, insulated from said slot antenna and said first and second metallic surface in a neighborhood of said slot antenna, and receiving power in non-contact coupling from said slot antenna.

17. The antenna device of claim 16, wherein said antenna conductor is a linear conductor having a length of approximately the half wavelength.

18. The antenna device of claim 16, wherein said antenna conductor is a linear conductor bent and snaked in a U-shape having a length of approximately the half wavelength.

19. The antenna device of claim 16, wherein said antenna conductor is a spiral conductor having a length of approximately the half wavelength.

20. The antenna device of claim 16, wherein said antenna conductor is a linear conductor bent and snaked in a V-shape having a length of approximately the half wavelength.

21. An antenna device comprising:

a cabinet having a planar metallic surface serving as a grounding conductor on the outside thereof, a substantially rectangular conductor provided transverse to the plane of the metallic surface, the substantially rectangular conductor having a pair of grounding portions that contact one side of said metallic surface and being bent in a V-shape to displace a distance between the pair of grounding portions from the half wavelength relative to a frequency of use, the substantially rectangular conductor serving as a ground conductor and forming a V-shaped slot with the one side of the metallic surface, the slot having a length that is approximately equal to the half wavelength relative to the frequency of use and having a depth that is sufficiently smaller than the wavelength so as to constitute a slot antenna;

a power supply line grounded to an area of the metallic surface where the slot is formed, and operating to supply power to said slot antenna; and an antenna conductor which is substantially perpendicular to the plane of the metallic surface, insulated from said slot antenna and said metallic surface in a neighborhood of said slot antenna, and receiving power in non-contact coupling from said slot antenna.

22. The antenna device of claim 21, wherein said antenna conductor is a linear conductor having a length of approximately the half wavelength.

23. The antenna device of claim 21, wherein said antenna conductor is a linear conductor bent and snaked in a U-shape having a length of approximately the half wavelength.

24. The antenna device of claim 21, wherein said antenna conductor is a spiral conductor having a length of approximately the half wavelength.

25. The antenna device of claim 21, wherein said antenna conductor is a linear conductor bent and snaked in a V-shape having a length of approximately the half wavelength.

26. An antenna device comprising:

a cabinet having a planar metallic surface serving as a grounding conductor on the outside thereof;

a substantially rectangular conductor provided transverse to the plane of the metallic surface, the substantially rectangular conductor having a pair of grounding portions that contact one side of said metallic surface and being bent in a U-shape to displace a distance between the pair of grounding portions from the half wavelength relative to a frequency of use, the substantially rectangular conductor serving as a ground conductor and forming a U-shaped slot with the one side of the metallic surface, the slot having a length that is approximately equal to the half wavelength relative to the frequency of use and having a depth that is sufficiently smaller than the wavelength so as to constitute a slot antenna;

a power supply line grounded to an area of the metallic surface where the slot is formed, and operating to supply power to said slot antenna; and an antenna conductor which is substantially perpendicular to the plane of the metallic surface, insulated from said slot antenna and said metallic surface in a neighborhood of said slot antenna, and receiving power in non-contact coupling from said slot antenna.

27. The antenna device of claim 26, wherein said antenna conductor is a linear conductor having a length of approximately the half wavelength.

28. The antenna device of claim 26, wherein said antenna conductor is a linear conductor bent and snaked in a U-shape having a length of approximately the half wavelength.

29. The antenna device of claim 26, wherein said antenna conductor is a spiral conductor having a length of approximately the half wavelength.

30. The antenna device of claim 26, wherein said antenna conductor is a linear conductor bent and snaked in a V-shape having a length of approximately the half wavelength.

31. The antenna device of claim 26, further comprising:

a clip attached to a bent portion of the substantially rectangular conductor, said clip being movable along a line perpendicular to the plane of said metallic surface at the bent portion.

32. The antenna device of claim 31, wherein said antenna conductor is a linear conductor having a length of approximately the half wavelength.

33. The antenna device of claim 31, wherein said antenna conductor is a linear conductor bent and snaked in a U-shape having a length of approximately the half wavelength.

34. The antenna device of claim 31, wherein said antenna conductor is a spiral conductor having a length of approximately the half wavelength.

35. The antenna device of claim 31, wherein said antenna conductor is a linear conductor bent and snaked in a V-shape having a length of approximately the half wavelength.

* * * * *